United States Patent [19]

Jean et al.

[11] Patent Number: 4,973,385

[45] Date of Patent: Nov. 27, 1990

[54] VACUUM WATER DRAWING CYLINDER FOR MAKING PAPER

[76] Inventors: Ming-Gwo Jean; Ming-Ren Jean, both of No. 6-4, Lane 28, Sec. 2, Hsin Sheng N. Rd., Taipei, Taiwan

[21] Appl. No.: 513,820

[22] Filed: Apr. 24, 1990

[51] Int. Cl.[5] ..... D21F 1/40; D21F 3/10

[52] U.S. Cl. ..... 162/368; 29/123; 210/404; 162/357

[58] Field of Search ..... 162/357, 368, 369, 370; 29/121.3, 123; 210/402, 404

[56] References Cited

U.S. PATENT DOCUMENTS 3,201,309 8/1965 Stuebe et al. ..... 162/357
3,455,454 7/1969 Sheaffer ..... 210/404
3,773,614 11/1973 Pennington ..... 162/357
4,683,059 7/1987 LaValley ..... 162/369

*Primary Examiner*—Karen M. Hastings
*Attorney, Agent, or Firm*—Morton J. Rosenberg; David I. Klein

[57] ABSTRACT

This invention relates to a vacuum water drawing windlass for making paper and in particular to one mainly including a tubular member, a bushing fitted on each end of the tubular member, a controlling disc rigidly engaged with the other side of each bushing, a case fixedly engaged with each controlling disc, a shaft inserted into each end of the tubular member and two brackets for supporting the tubular member whereby the paper production may be increased and the quality of the paper may be improved.

1 Claim, 6 Drawing Sheets

VACUUM WATER DRAWING CYLINDER FOR MAKING PAPER

BACKGROUND OF THE INVENTION

It is found that the conventional paper making process is inefficient and limited in production which will be described as follows:

Referring to FIG. 1, raw material is first fed into an inlet neat the bottom of a barrel 1 and then transferred to a spiral netting wheel 2 made of stainless steel so as to form a sheet of thin paper 3. The thickness of the paper 3 depends on the mesh number of the netting wheel 2. The paper 3 just formed contains a lot of water which is removed by the spiral netting wheel 2 and then attachs on a blanket 5 having pressed by two pressure rollers 4. Thereafter, the paper 3 together with the blanket 5 is transmitted to a drain tank 6 where the water contained in the blanket 5 is sucked out by drawing air from the drain tank 6. Finally, the paper 3 is baked and dried by a heated roller 7 to form a finished product.

However, a relatively large friction will exist between the blanket 5 and the drain tank 6 when the former is moved across the latter thereby limiting the production. Further, it is necessary to provide a large driving force in order to move the blanket across the drain tank 6.

It is, therefore, an object of the present invention to provide an expedient to obviate and mitigate the above-mentioned drawbacks.

SUMMARY OF THE INVENTION

This invention relates to a vacuum water drawing windlass or cylinder for use in making paper.

It is the primary object of the present invention to provide a vacuum water drawing windlass which may increase paper production.

It is another object of the present invention to provide a vacuum water drawing windlass which is energy saving.

It is still another object of the present invention to provide a vacuum water drawing windlass which may ensure the quality of the paper.

It is still another object of the present invention to provide a vacuum water drawing windlass which may be used to produce thicker paper.

It is a further object of the present invention to provide a vacuum water drawing windlass which is simple in construction.

Other objects and merits and a fuller understanding of the present invention will be obtained by those having ordinary skill in the art when the following detailed description of the preferred embodiment has been read in conjunction with the accompanying drawings wherein like numerals refer to like or similar parts.

DETAILED DESCRIPTION OF THE PREFERRED EMBODIMENT

Figure 1:
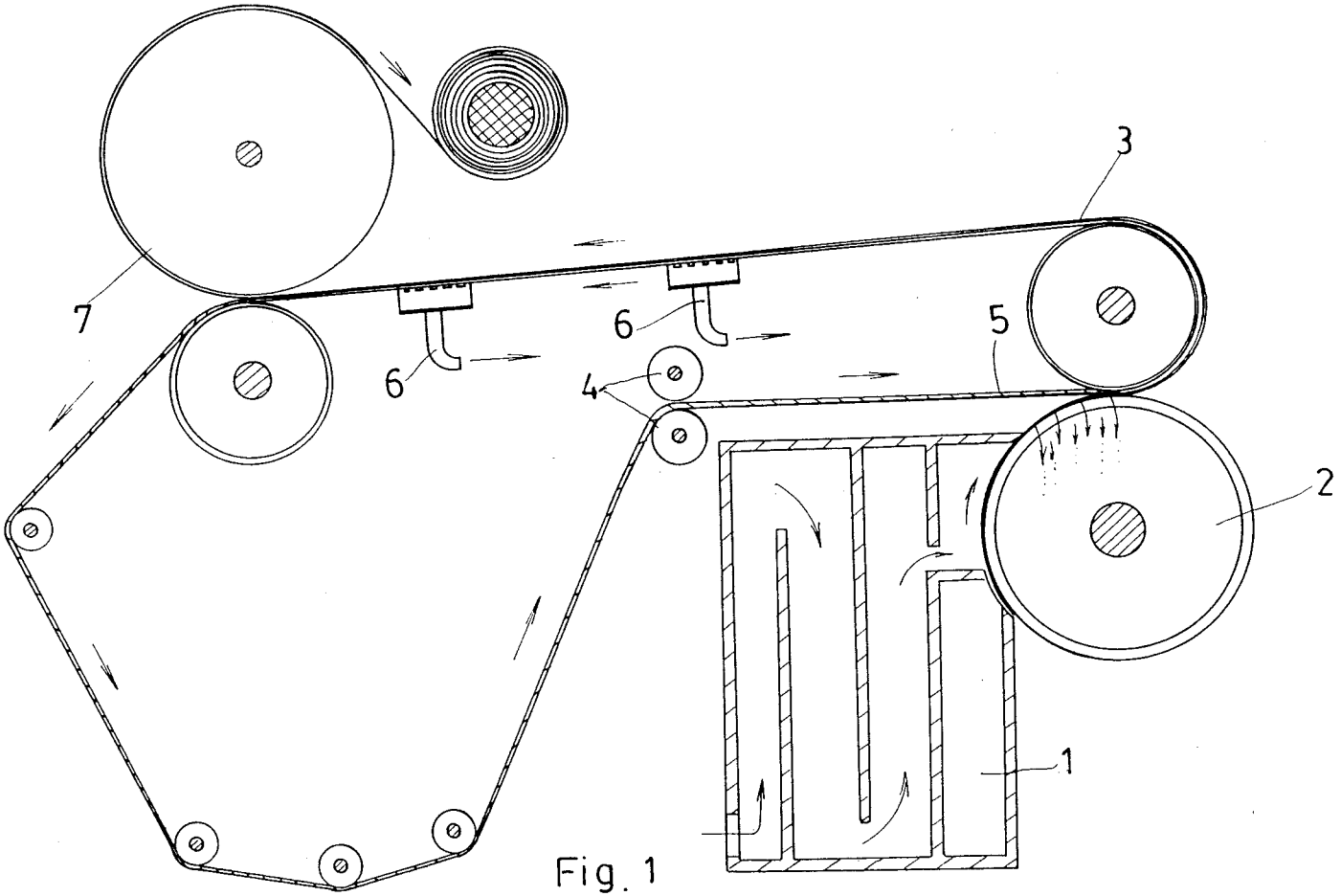
Fig. 1 PRIOR ART
FIG. 1 shows the paper making process according to the prior art.
Figure 2:
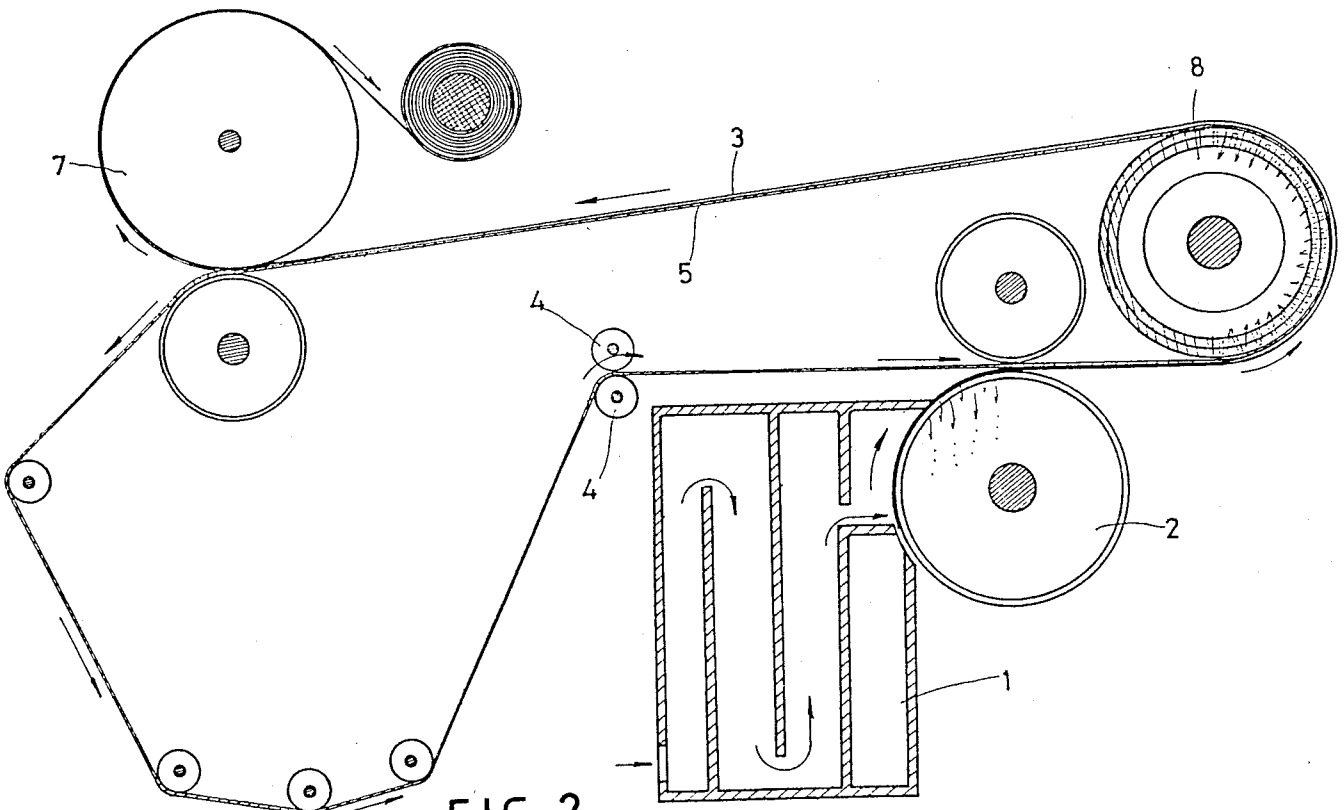
FIG. 2 shows the paper making process according to the present invention.

FIG. 2 shows the paper making process according to the present invention wherein the drain tank 6 of the prior art is replaced with a vacuum water drawing windlass.

Figure 3:
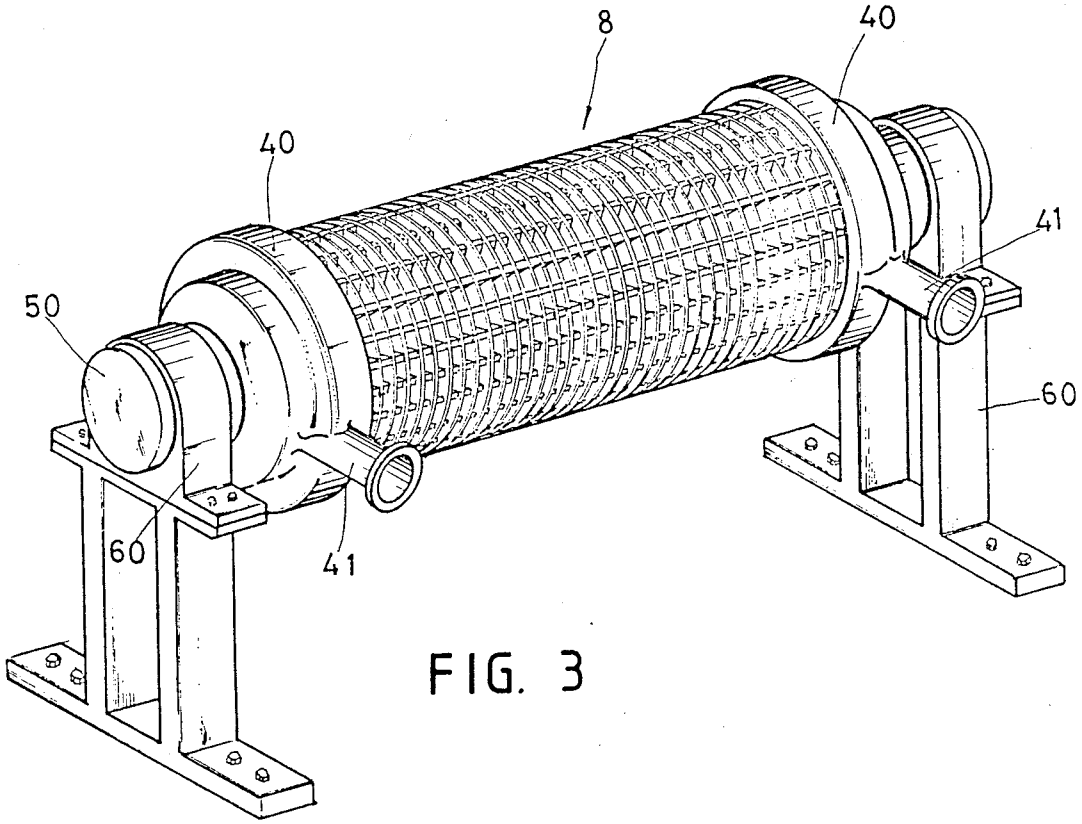
FIG. 3 is a perspective view of a vacuum water drawing windlass according to the present invention.
Figure 4:
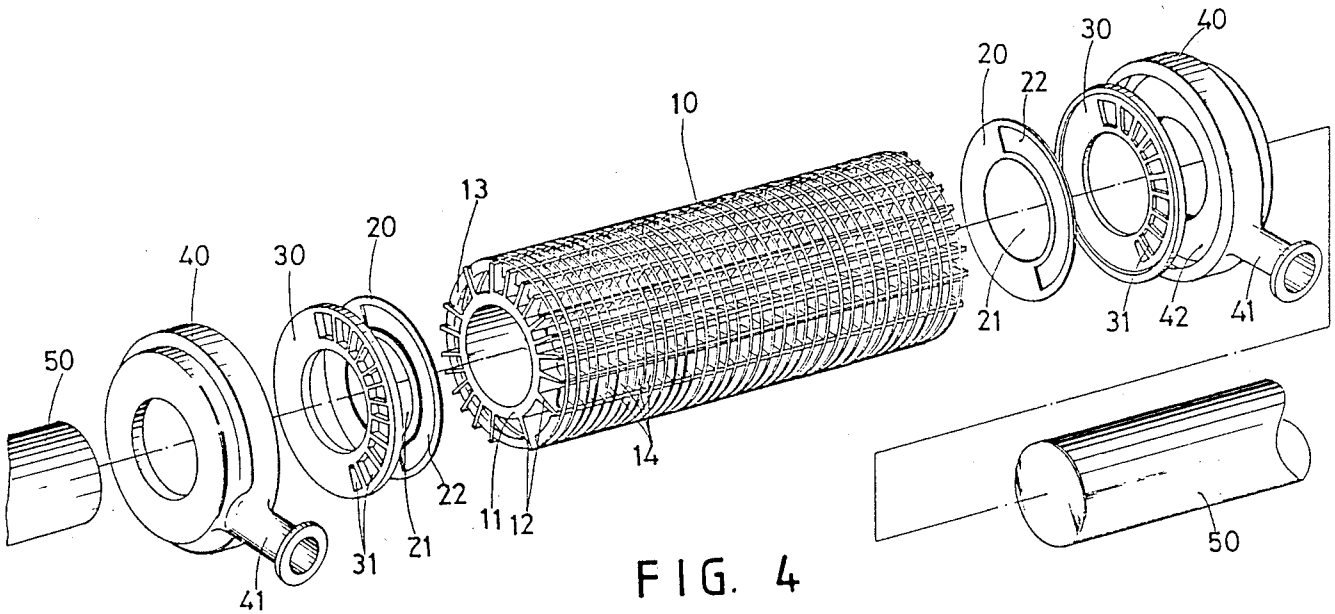
FIG. 4 is an exploded view of the vacuum water drawing windlass.
Figure 5:
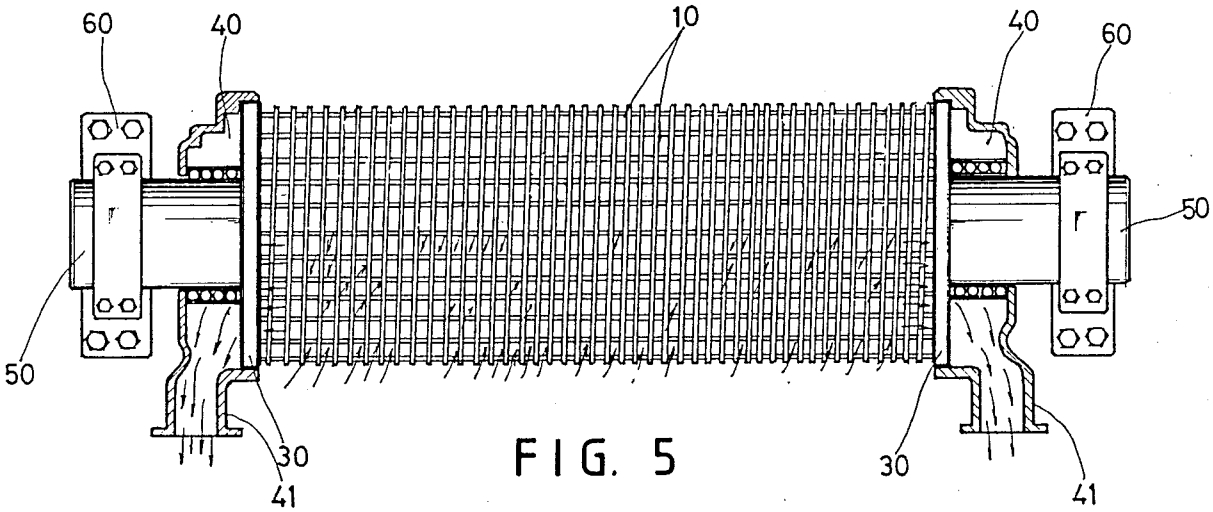
FIG. 5 shows the principle of the vacuum water drawing windlass.
Figure 8:
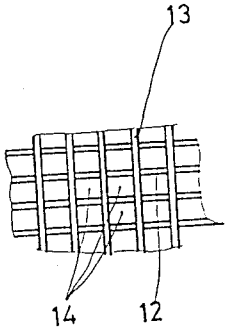
FIG. 8 is an enlarged fragmentary view showing the surface of the vacuum water drawing windlass.
Figure 7:
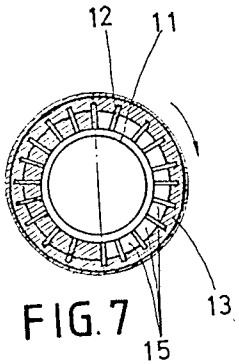
FIG. 7 shows how the controlling disc of the vacuum water drawing windlass works.
Figure 6:
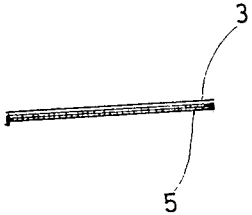
FIG. 6 shows the way how the paper is attached on a blanket.

With reference to the drawings and in particular to FIGS. 3 and 4, the vacuum water drawing windlass mainly comprises cylinder 10, a bushing 20 at both ends of the cylinder 10, a controlling disc 30 at the outer side of each bushing 20, a case 40 at the outer side of each controlling disc 30 and an axle 50 inserted into each end of the cylinder 10. The cylinder 10 is generally a tubular member 11 provided with a plurality of longitudinal ribs 12 and a strip element 13 spiraled round the tubular member 11 thereby dividing the surface of the windlass into a plurality of lattices 14. An axle 50 is inserted into each end of tubular member 11 through a bushing 20. The controlling disc 30 and the case 40 are fixedly mounted on two brackets 60.

The bushing 20 is fitted in the inner side of the controlling disc 30 so as to enhance the sealing at both ends of the cylinder 10. Further, the bushing 20 has a center hole 21 with the same diameter as the axle 50 and a groove 22 extending one half circumference of the bushing 20 to cover the lattices 15 formed between the ribs 12 of the tubular member 11. The controlling disc 30 is fitted into the recess 42 of the case 40 and also has a center hole for the passage of the axle 50. On one half of the controlling disc 30 there are a plurality of lattices 31 with the same length and width as the lattice 15 so that the controlling disc 30 may always close one half of the lattices 15. The case 40 has an outlet 41 at one side and a center hole for the passage of the axle 11 into the tubular member 11.

Looking now at FIGS. 5, 6, 7 and 8, a blanket 5 is wrapped round half surface of the cylinder 10 and has thereon a sheet of thin paper 3 containing a lot of water hence separating the surface of the cylinder 10 from outside. As air is drawn out from the case 40 via the outlet 41 and the cylinder-10 begins to rotate, the other half surface of the cylinder 10 is closed by the controlling disc 30 and so the water stored in the blanket 5 and the thin paper 3 wrapped on half surface of the cylinder 10 will be drawn out into the cylinder 10.

When in operation, the cylinder 10 is kept rotating so as to draw out the water in the blanket 5 and the paper 3 whereas the bushing 20, the controlling disc 30 and the case 40 is kept stationary. Thus, when the cylinder 10 rotates, only one half surface thereof (the surface covered by the blanket 5 and the paper 3) is open.

Referring again to FIGS. 7 and 8, as water is drawn out from the blanket 5 and the paper 3 into the cylinder 10, the water is evaporated into vapor which is then drawn out of the tubular member 11 together with the air. The water drops are also drawn out of the tubular member 11 simultaneously.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A vacuum water drawing cylinder comprising:

a tubular member provided with a plurality of longitudinal ribs and a strip element spiraled round the tubular member thereby dividing surface of the tubular member into a plurality of lattices;

a bushing having a circumference and having one side fixedly fitted on each end of said tubular member and having a center hole and a groove extending one half circumference of the bushing to cover lattices formed between the ribs of said tubular member;

a controlling disc rigidly engaged with the other side of each bushing and having a circumference and a center hole and on one half circumference of the disc having a plurality of lattices with same length and width as the lattices formed between the ribs of said tubular member so that the controlling disc always closes one half of the lattices formed between the ribs of said tubular member;

a case fixedly engaged with each controlling disc and having a center hole and means defining an outlet from which air may be drawn out;

a shaft inserted from each end of said tubular member through said bushing, said controlling disc and said case; and two brackets for supporting said tubular member.

* * * * *